US005605455A

United States Patent [19]

Melotti

[11] Patent Number: 5,605,455

[45] Date of Patent: Feb. 25, 1997

[54] KILN WITH DISPLACEABLE FRAMES FOR THE FIRING OF MANUFACTURED ARTICLES

[75] Inventor: Carlo Melotti, Modena, Italy

[73] Assignee: Mori S.p.A., Modena, Italy

[21] Appl. No.: 513,669

[22] Filed: Aug. 3, 1995

Related U.S. Application Data

[63] Continuation of Ser. No. 325,546, Oct. 18, 1994, abandoned, which is a continuation of Ser. No. 980,799, filed as PCT/EP91/00994 May 29, 1991, published as WO92/04588 Mar. 19, 1992, abandoned.

[30] Foreign Application Priority Data

Sep. 3, 1990 [IT] Italy ..... 40117/90

[51] Int. Cl.[6] ..... F27D 3/00

[52] U.S. Cl. ..... 432/246

[58] Field of Search ..... 432/246, 236

[56] References Cited

U.S. PATENT DOCUMENTS

| | | | |
|---|---|---|---|
| 2,173,682 | 9/1939 | Fahrenwald | 263/28 |
| 4,225,197 | 9/1980 | Mantegani | 432/246 |
| 4,352,230 | 10/1982 | Sukenik | 432/246 |
| 4,500,287 | 2/1985 | Carraroli et al. | 432/246 |

FOREIGN PATENT DOCUMENTS

| | | |
|---|---|---|
| 0148804 | 7/1985 | European Pat. Off. . |
| 3515856 | 7/1986 | Germany . |
| 3740619 | 12/1988 | Germany . |
| 3842497 | 11/1989 | Germany . |

*Primary Examiner*—Noah P. Kamen

*Attorney, Agent, or Firm*—John T. McNelis; Edward J. Radlo; J. P. Violette

[57] ABSTRACT

The kiln with displaceable frames, designed to contain also manufactured articles of considerable mass avoiding any direct contact between them and the motor rollers which causes thickenings, is provided with a formation of short transverse, non-through, rollers (22), distributed in two opposite rows to define at least one plate of transport, said rollers extending in an overhanging manner towards the inside of the lateral walls of the kiln; a loading frame (28), rectangular or square, constituted by a pair of stringers (29) connected rotationally to the internal ends of said rollers and interconnected by transverse elements (30) for supporting the manufactured articles to be treated, is introduced into the kiln and guided by lateral surfaces; the kiln is used in industries in which drying or firing of manufactured articles, for instance ceramic articles such as sanitary apparatus, is made.

9 Claims, 8 Drawing Sheets

KILN WITH DISPLACEABLE FRAMES FOR THE FIRING OF MANUFACTURED ARTICLES

RELATED APPLICATIONS

This is a continuation of U.S. patent application Ser. No. 08/325/546 filed on Oct. 18, 1994, abandoned, which was a continuation of U.S. patent application Ser. No. Feb. 26, 1993, filed as PCT/EP91/00994 on May 29, 1991 published as WO92/04588 Mar. 19, 1992, abandoned.

FIELD OF THE INVENTION

The invention relates to a kiln with displaceable frames for the firing of manufactured articles, that is to say a kiln in which the material to be fired, or to be treated thermally somehow, is loaded onto frames which are rendered movable inside the kiln itself.

BACKGROUND OF THE DISCLOSURE

The state of the art comprises, for the firing or the drying of manufactured articles which are mainly made of ceramic material, so-called tunnel kilns, in which the products to be subjected to heat treatment are loaded onto containers made of refractory material on board trolleys which pass through the kiln, the firing cycle of the material taking place at predetermined times and rates. It also comprises kilns in which the material is loaded onto motorised transverse rollers which cross the kiln for the transport of the same material in the longitudinal direction, the external ends of each roller being rotatably supported close to the lateral walls of this kiln.

DE 35 15 856 discloses a tunnel kiln having two opposite rows of transport rollers which pass through the opposite side walls of the kiln; the internal ends of said rollers being equipped with wheels lying on the floor of the kiln, in order to support and transport in a longitudinal direction a pair of longitudinal beams hold between flanges protruding circumferentially from said wheels; said longitudinal beams supporting a number of cross members in order to constitute a loading frame for the items to be treated in the kiln.

Moreover, in the tunnel kilns, considerable thermal power is used for the heating of the trolley, with a consequent reduction of the relative thermal efficiency; furthermore, each trolley, which consists of an expensive metal structure covered in refractory material, needs frequent maintenance operations with regard on the one hand to the restoration of the covering, which tends to break up as a result of the thermal shocks and of the inevitable knocks during movement, and on the other hand to the necessity of frequent greasing of the hubs of the wheels, to avoid their deterioration and the consequent seizing.

As far as the rollers are concerned, these become encrusted through contact with the wet and/or green glaze material, causing obstacles to the flow of the material, with possible harmful moving across and thickening of this towards the walls, avoidable only by means of periodic thorough cleaning of the rollers, to be carried out by the previous extraction of the same through the walls of the kiln, which, employing considerable labour, necessitates large spaces for manoeuvring at the side of the kiln and great financial outlay, the latter also being contributed to by the breaking of rollers which occurs during the cleaning phase, especially in the case of rollers of considerable length which have modest carrying capacity.

Another disadvantage, in the case of manufactured articles which are short in relation to the interval of the rollers, derives from the need to support them by the interposition of plates which are subject to harmful deviations in trajectory, particularly in the case of encrusted rollers.

Furthermore, the width of the kiln is limited by the maximum length which can be assigned to the rollers; this latter, which is currently not greater than 3.4 m, does not in fact permit the firing of products of large dimensions, which, however, is desirable.

In the kiln according to DE 35 15 856 the wheels fastened at the internal ends of each roller rotate in contact with the floor of the kiln thus generating a frictional tangential force resulting in a lateral bending stress and a torsion stress on each roller and in an increase of drive torque for each roller; particularly when heavy items are to be conveyed.

Furthermore, the sliding friction between the wheels and the floor of the kiln causes a considerable loss of energy and a rapid wearing of the floor of the kiln in the contact areas between the floor and the wheels, which can result in an unbalanced distribution of the loads on the rollers due to a misalignment of the axes thereof.

This state of the art is susceptible to considerable improvements with regard to the possibility of avoiding the disadvantages indicated above. What has been stated above gives rise to the need for a solution to the technical problem of obtaining a kiln for the firing or the drying of manufactured articles, in particular of ceramic material, which are also of considerable mass and dimensions, which kiln permits considerable reductions in consumption, waste and maintenance, in order to achieve a great reduction in costs, such a kiln also having to allow both the method of firing manufactured articles by continuous unidirectional passing through, and that by alternating or intermittent flow; the mechanical wearing of the floor of the kiln being also eliminated.

SUMMARY OF THE INVENTION

The invention solves the abovementioned technical problem by adopting a kiln comprising an external support structure, an insulating shell for the internal walls of the kiln, a plurality of gas burners arranged at the bottom and at the top in relation to the product to be fired, there being provided short transverse, non-through, transport rollers which are motorised and distributed in two opposite rows to define in each case, in the totality of the upper generating lines, at least one plane of transport, with the rollers of each row extending in an overhanging manner from the outside towards the inside of the kiln, through the lateral walls of the latter, at least sufficiently to pass through them, a rectangular or square loading frame, which has sides which consist of at least a pair of coplanar longitudinal stringers, between which are inserted transverse elements for supporting, directly or by means of refractory supports, the manufactured articles to be treated, being introduced into the kiln, with the lower surfaces of these stringers simultaneously connected rotationally to the internal ends, of reduced diameter or otherwise, of at least two opposite pairs of said short transport rollers, and the external lateral surfaces of the pair of longitudinal stringers being inserted between vertical guides.

The advantages achieved by this invention are the possibility of firing manufactured articles of considerable dimensions also, the useful width of the kiln being independent of the length of the rollers, a reduction in the percentage of waste, a considerable reduction in consumption and in maintenance operations, the possibility of increasing the interval between the short transverse transport rollers, independently of the longitudinal dimensions of the manufactured articles to be fired also, with a consequent reduction in costs, a considerable increase in productivity, in the case also of manufactured articles of dimensions which are not great, and a drastic reduction in the space necessary at the sides of the kiln for the extraction of said rollers; elimination of the mechanical wearing of the floor of the kiln; considerable reduction of the energy required by the roller drive means.

BRIEF DESCRIPTION OF THE DRAWINGS

Some embodiments of the invention are illustrated, by way of exemplification only, in the eight plates of drawings attached, in which.

DETAILED DESCRIPTION OF THE PREFERRED EMBODIMENTS

Figure 1:
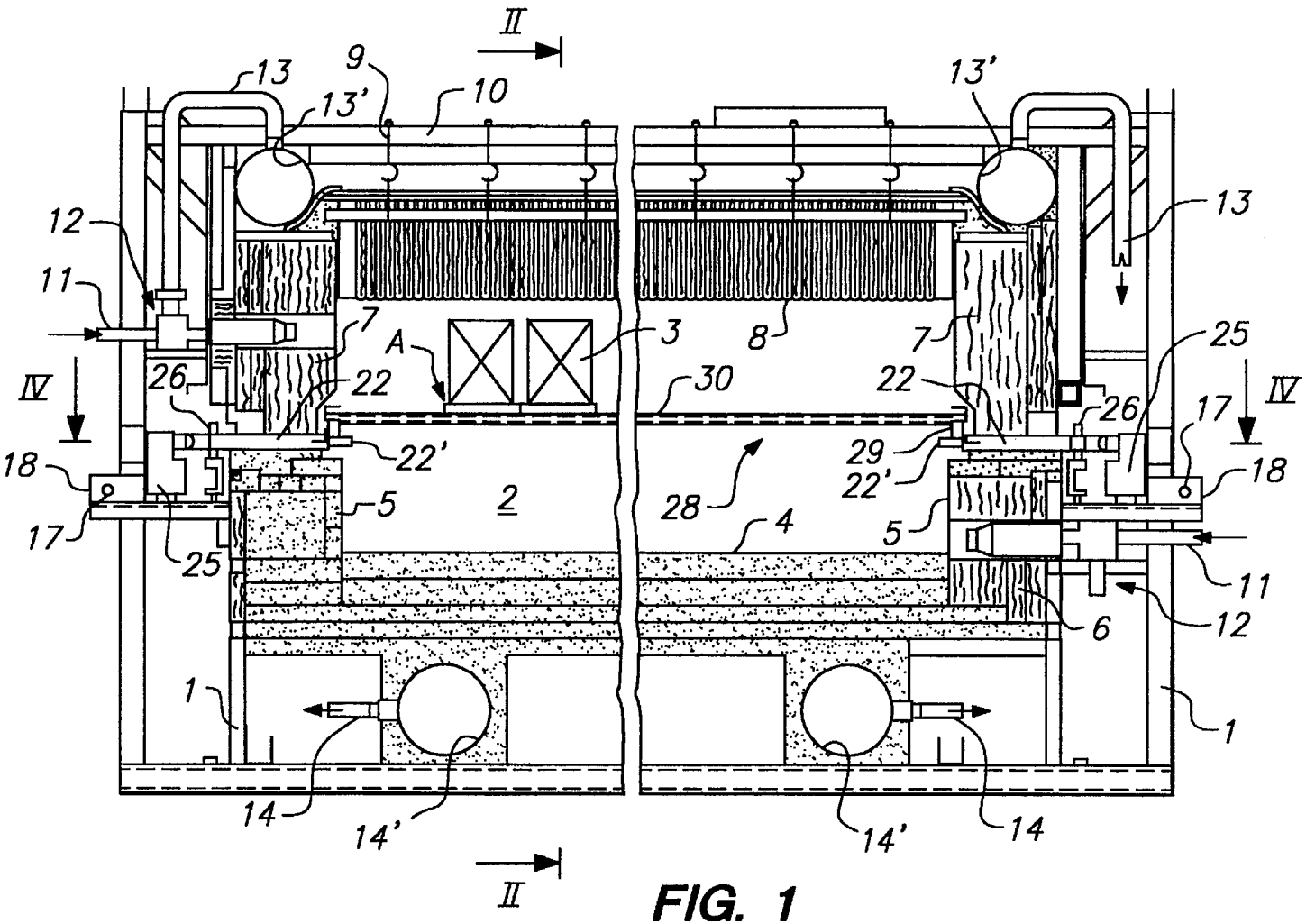
FIG. 1 is a transverse and interrupted vertical cross-section of the roller kiln according to the invention in the continuous cycle alternative.
Figure 2:
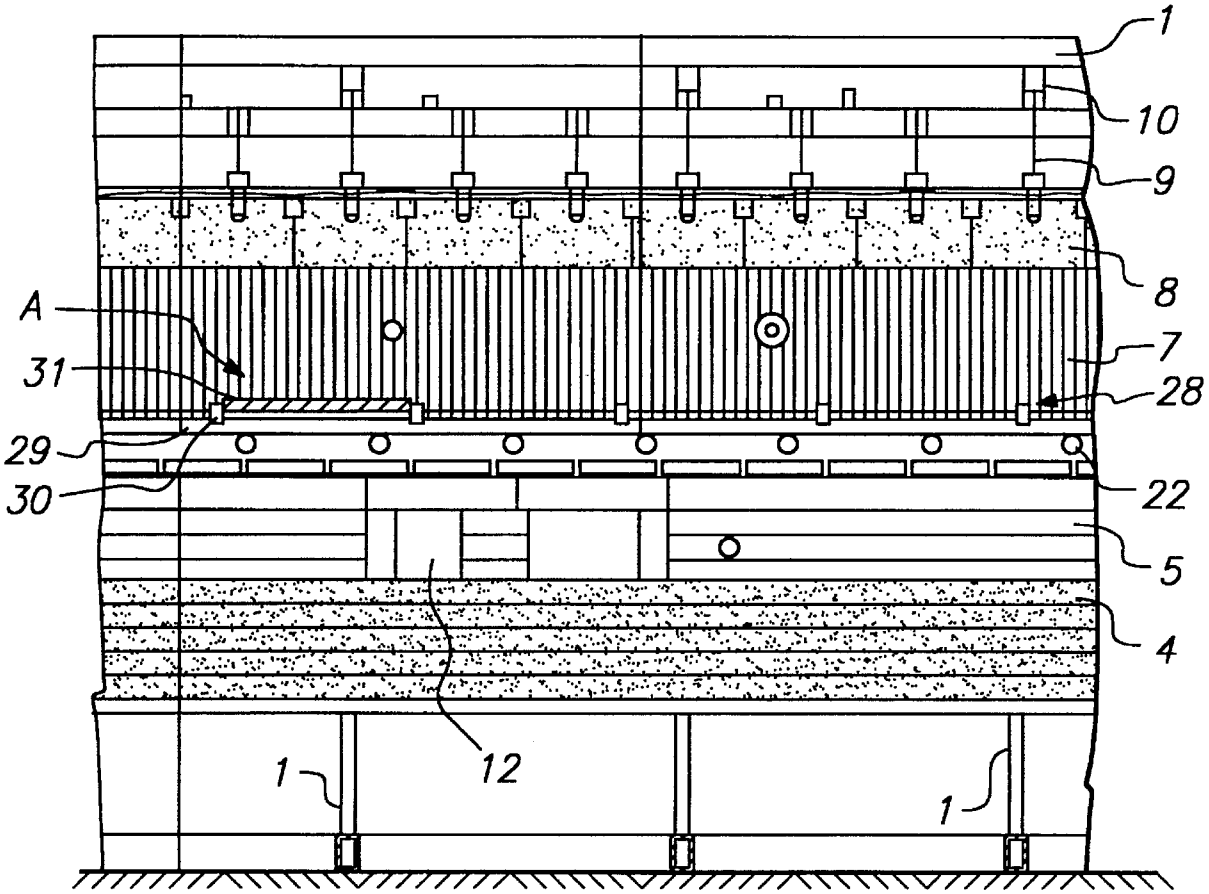
FIG. 2 is the vertical and interrupted longitudinal cross-section along II—II in FIG. 1.
Figure 3:
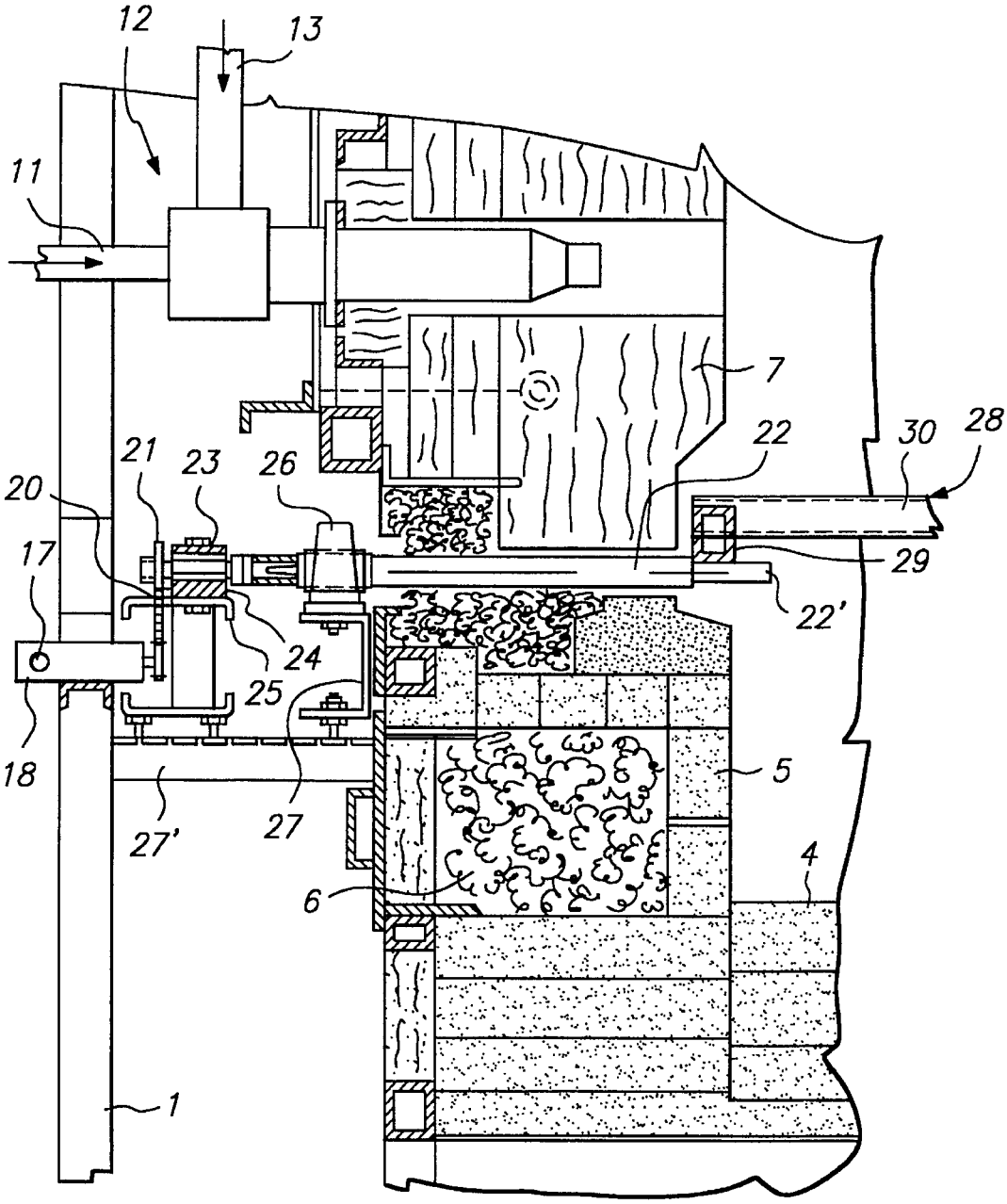
FIG. 3 is the enlarged detail of the cross-section of the left side of the kiln in FIG. 1, showing the burner and the chain-type kinematic motion for movement of said rollers.
Figure 4:
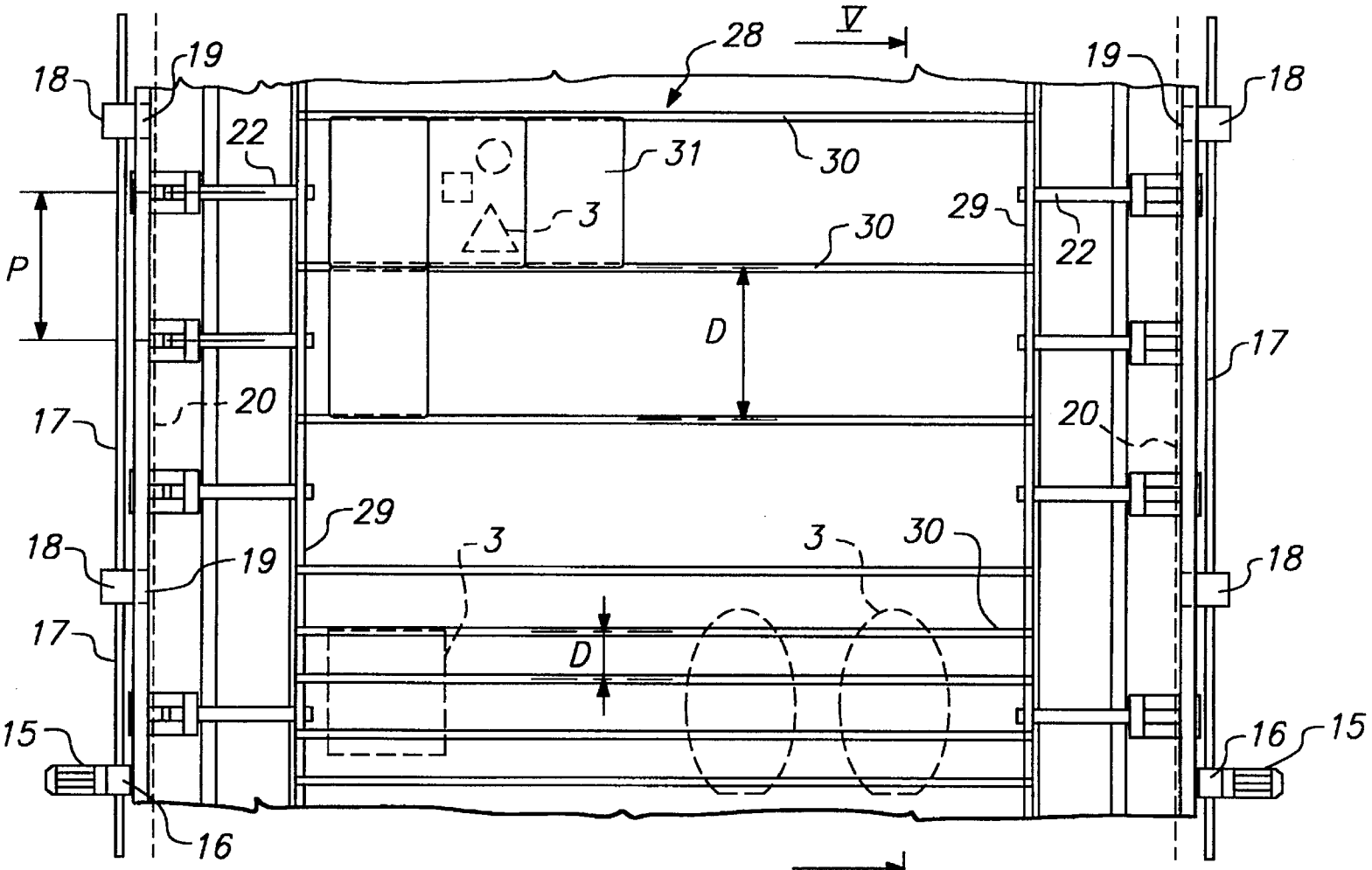
FIG. 4 is the partial and interrupted horizontal cross-section along IV—IV in FIG. 1.
Figure 5:
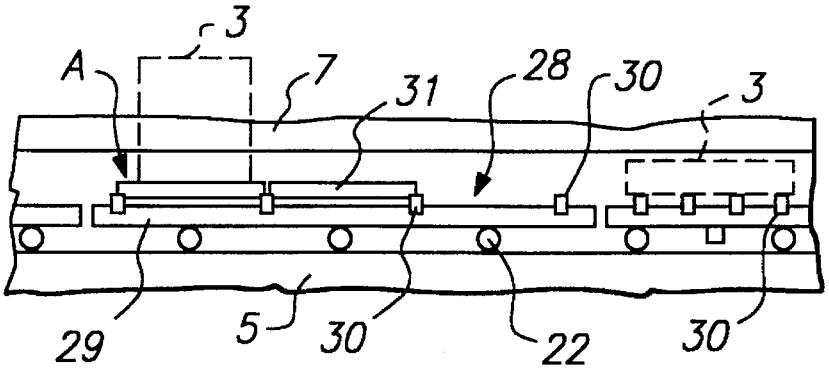
FIG. 5 is the longitudinal vertical cross-section along V—V in FIG. 4.
Figure 6:
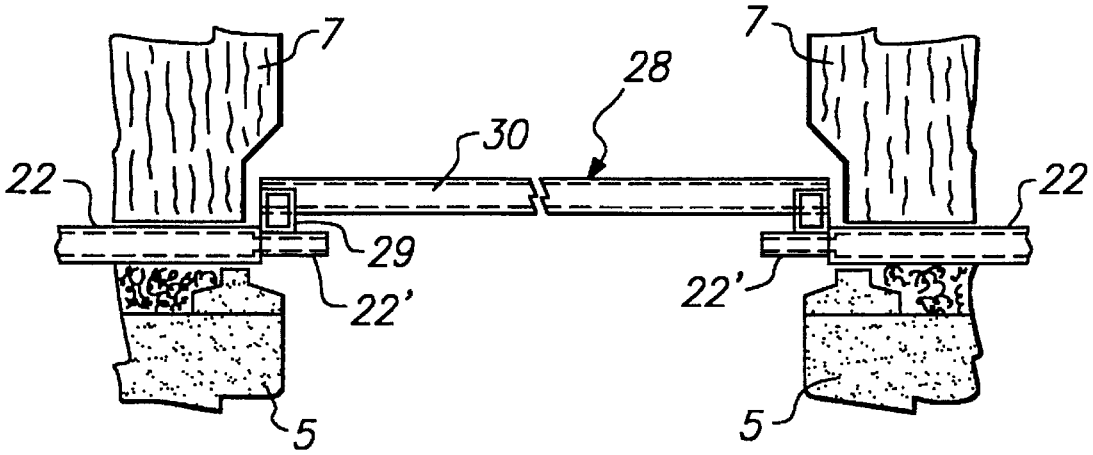
FIG. 6 is the enlarged detail of a pair of corresponding short transverse transport rollers, with internal ends of smaller diameter for supporting the guided longitudinal-displacement loading frame.
Figure 7:
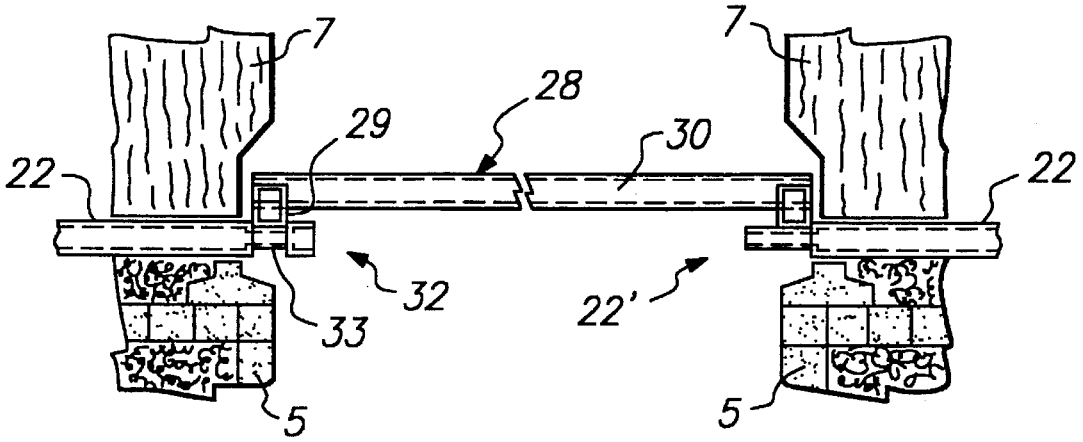
FIG. 7 is a view like that in FIG. 6, but with the internal end of the short transverse transport roller provided with a suitable guide groove for the loading frame.
Figure 8:
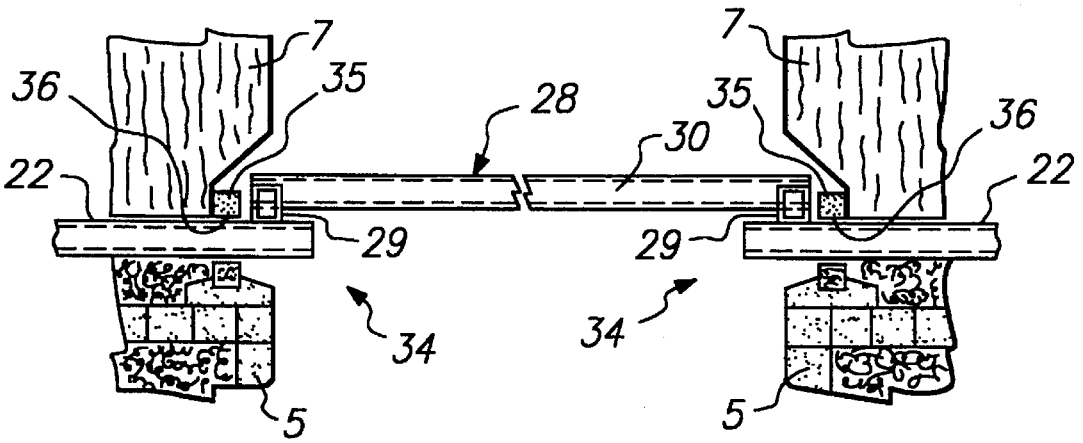
FIG. 8 is a view like that in FIG. 6, but with short transport rollers of constant diameter and a pair of lateral guides made of refractory material.
Figure 9:
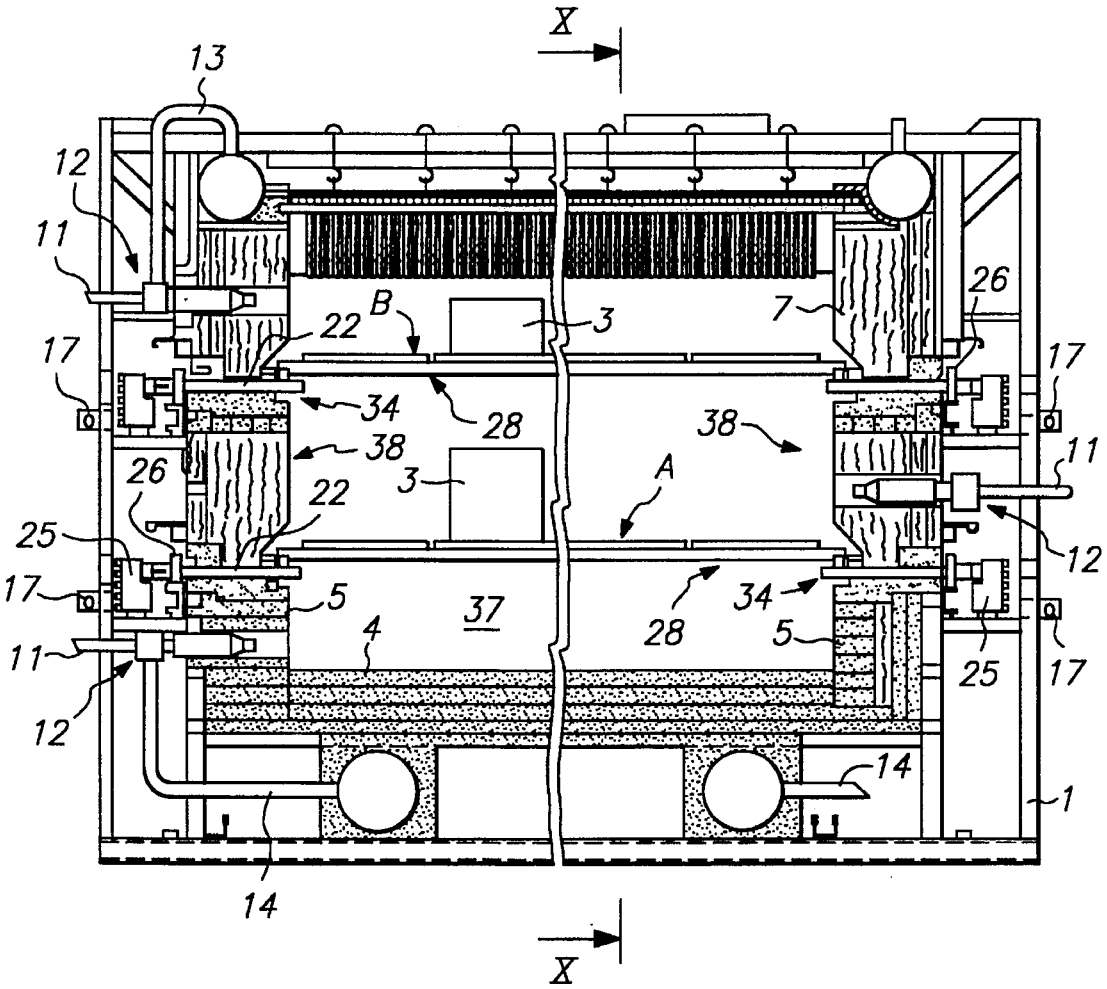
FIG. 9 is a transverse vertical cross-section like that in FIG. 1, but in the case of double-layer transfer of the manufactured articles.

Numeral 1 indicates the external tubular support framework of the kiln according to the invention; 2 indicates the transverse clearance of the kiln; 3 indicates the material being fired, said kiln being covered at the bottom, in the event of use for temperatures in the region of 1300° C., with insulating blocks 4; 5 indicates a pair of walls consisting of insulating bricks, to cover the lower lateral parts of the kiln, a corresponding pair of external insulating layers 6 made of fibroceramic material being provided externally to said pair of walls; 7 indicates a similar layer made of fibroceramic material for covering the upper portion of the lateral walls of the kiln in relation to the plane of transport A of the manufactured articles; 8 indicates the crown of the kiln, which consists of insulating elements and is suspended by means of tie rods 9 from the upper crosspieces 10 of the framework 1; 11 indicates the intake pipe for the fuel gas relative to the supply of each burner 12; 13 indicates the relevant upper supply pipe for primary air, derived from the upper longitudinal duct 13'; 14 indicates a corresponding lower supply pipe for air, derived from the lower longitudinal duct 14'; 15 (FIG. 4) indicates the motor for the movement of a group of short transverse transport rollers, which is coupled to a first speed reducer 16, with axes at right angles, the opposite longitudinal output shafts 17 of which operate a series of reducers 18 at right angles, provided with output pinions 19 which move the chain 20 along each side of the kiln; 21 (FIG. 3) indicates the external end pinion for the movement of each short transverse, non-through, transport roller 22, operated by the chain 20, the internal end 22' of said roller being of reduced diameter in order to constitute, in the region of the reduction in diameter, a longitudinal vertical guide; 23 indicates the shaft of the pinion 21, which is rotatably coupled to the external support 24 which is fixed to the external side member 25 which is integral with the framework 1, the internal end of the shaft 23 being provided with a spring-coupling for its insertion into the corresponding external end of the short transverse transport roller 22; 26 indicates the cantilever support of each said roller, installed on the relevant, more internal side member 27; 27' indicates a series of horizontal crosspieces external to the lateral walls of the kiln, extending between these latter and the uprights of the framework 1 in order to hold up the side members 25 and 27; 28 indicates the rectangular or square displaceable loading frame, advantageously made of silicon carbide, on which the manufactured articles 3 to be fired are arranged; P (FIG. 4) indicates the interval between the axes of the short transverse transport rollers 22, the speeds of rotation of these latter being controlled by electric or electronic devices, for example so-called encoders, which synchronise the angular velocities of the motors 15; 29 indicates a pair of longitudinal stringers interconnected by crosspieces 30 which are separated from one another according to intervals D which depend upon the dimensions of the manufactured articles to be treated; 31 indicates support plates which can be used for the manufactured articles, in particular in the case of these being of small size, and rest on the crosspieces 30 of one of the loading frames 28; 32 (FIG. 7) indicates the internal end, of the same diameter, of the short transverse transport roller 22, in the alternative which provides a groove 33 for guiding and accommodating the stringer 29 of the loading frame 28, which groove is obtained by reduction of the diameter towards said end; 34 (FIG. 8) indicates the end without any reduction of the diameter of each of the short transverse transport rollers 22, when the displacement guide of the loading frame 28 is obtained by means of a pair of parapets 35 made of refractory material, said parapets having a series of holes 36 for the passage of said rollers through them; 37 (FIG. 9) indicates the internal chamber of the kiln in the case in which, in addition to the lower plane A for loading the manufactured articles, a second, upper plane B is provided; 38 indicates the insulating covering layer of the walls of the kiln, comprised between said loading planes A and B, which is advantageously made of refractory material, the distribution of the short transverse transport rollers 22 in relation to the upper loading plane, the motorisation, the mechanical transmission and the members for controlling the speed of rotation being entirely similar to those provided for the lower loading plane; 39 (FIG. 10) indicates transverse pipes for suction of the products of combustion; 40 indicates the door for access to the kiln, covered with insulating or fibroceramic material, in the case of a kiln for intermittent firing; 41 indicates the end wall of this kiln, similarly covered with insulating material.

Figure 10:
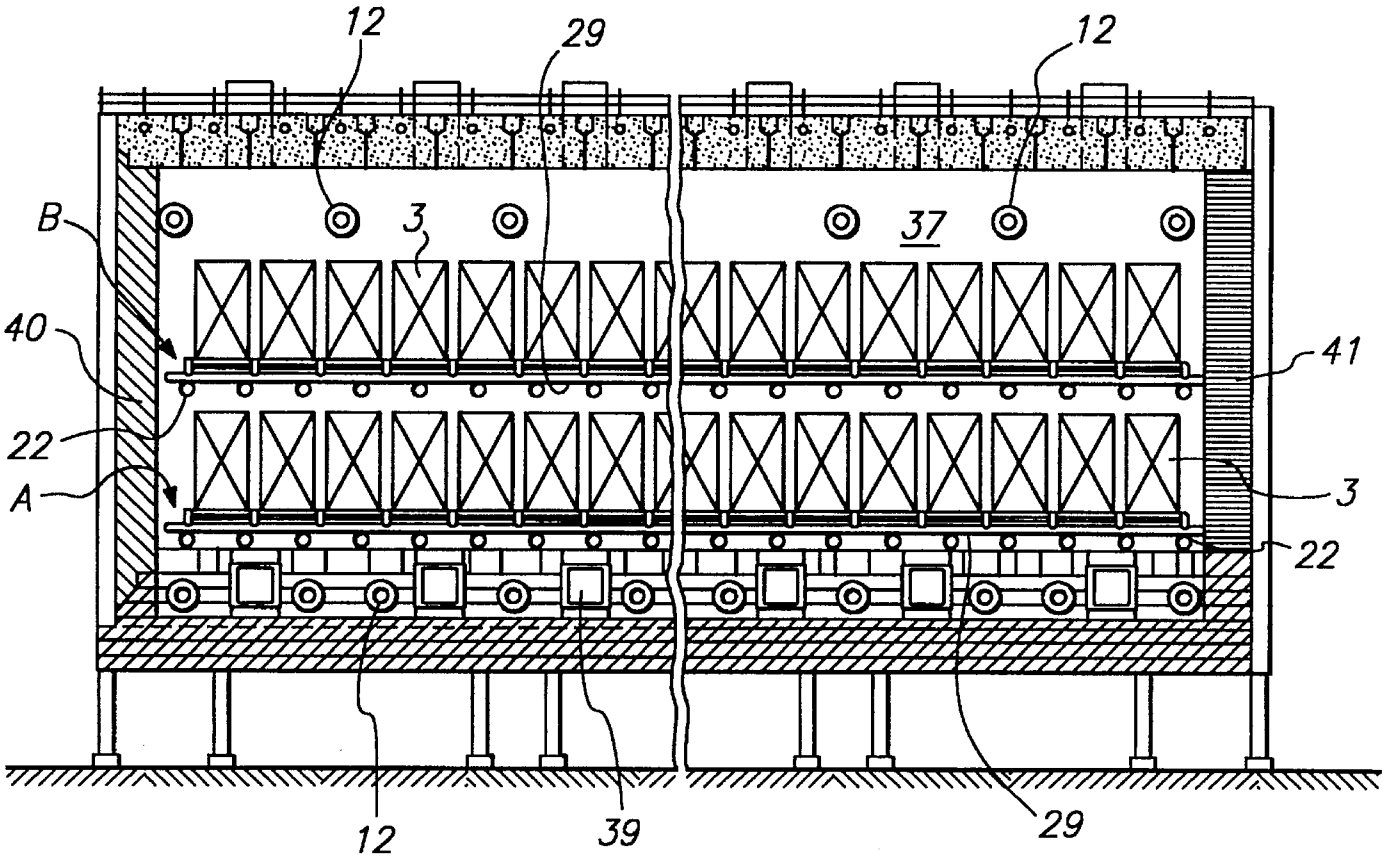
FIG. 10 is the longitudinal vertical cross-section of the kiln according to the invention, but in the case of alternating flow.

Functioning, in the case of FIGS. 1 to 9, takes place in the following manner: the manufactured articles 3 are loaded onto the frames 28 which are continuously drawn along by friction by the transverse rollers 22 and admitted to the chamber 2 of the kiln, in which they generally undergo an initial preheating followed by the firing and cooling phases, to exit at the end opposite that of entry; in the case of FIG. 10, however, the manufactured articles, which are introduced into the kiln through the door 40 of the entry section upon loading onto the frames 28 which are drawn inside the firing chamber by the short transverse rollers 22, remain inside the kiln for the entire duration of the cycle; when firing is completed, the direction of rotation of said short rollers is reversed, thus bringing about the exit of the loading frames.

In practice, the materials, the dimensions and the executive details can be different from those indicated, but technically equivalent to these, without for this reason leaving the legal scope of the present invention.

I claim:

1. A kiln with displaceable frames for the firing of manufactured articles, said kiln having an inside and an outside and comprising:

an external support structure;

fitting within the external support structure, an insulating shell defining internal walls of the kiln; and a formation of short transverse transport rollers passing through opposite internal walls of the kiln, said rollers being motorized and distributed in at least one pair of opposite rows to define at least one plane of transport, with each short roller having an outer end facing towards the outside of the kiln and an internal end facing towards the inside of the kiln, each roller being supported at said outer end, said internal end being free from any support, the internal ends of the rollers from each pair of opposite rows being aligned with each other;

wherein said internal end of each roller has a length which is a minute portion of the total length of each roller.

2. A kiln according to claim 1, wherein said internal end of each roller includes a guide designed to guide loading frames supporting the manufactured articles.

3. A kiln according to claim 2, wherein said guides are provided by a reduction of diameter of the internal ends of the transport rollers.

4. A kiln according to claim 2, wherein said guides include grooves provided at the internal ends of the transport rollers.

5. A kiln according to claim 2, wherein said guides include a pair of parapets for each pair of rollers, said parapets being provided with through-holes accommodating said transport rollers.

6. A kiln according to claim 1, wherein said rollers define a lower plane of transport and at least an upper plane of transport.

7. A kiln according to claim 6, wherein a plurality of gas burners is positioned, with respect to each said plane of transport, in at least one area from the group of areas comprising an area above the plane of transport and an area below the plane of transport.

8. A kiln, according to claim 2, wherein each loading frame comprises at least a pair of coplanar longitudinal stringers interconnected by crosspieces.

9. A kiln, according to claim 8, wherein said loading frames are equipped with support plates resting on the upper surface of said crosspieces.

* * * * *